United States Patent [19]

Feiten et al.

[11] Patent Number: 4,465,214

[45] Date of Patent: Aug. 14, 1984

[54] APPARATUS FOR GUIDING THE FOLDING BLADE AND FOR ACTUATING THE TILTING ARM OF THE BLADE BAR OF A PLEATING MACHINE

[75] Inventors: Erwin E. Feiten; Clemens M. Lehmann, both of Berlin, Fed. Rep. of Germany

[73] Assignee: Karl Rabofsky GmbH, Berlin, Fed. Rep. of Germany

[21] Appl. No.: 450,293

[22] Filed: Dec. 16, 1982

[30] Foreign Application Priority Data

Dec. 22, 1981 [DE] Fed. Rep. of Germany ..... 3151238

[51] Int. Cl.[3] ..... A41H 43/00

[52] U.S. Cl. ..... 223/30

[58] Field of Search ..... 223/28, 30, 31

[56] References Cited

U.S. PATENT DOCUMENTS

| | | | |
|---|---|---|---|
| 1,710,868 | 4/1929 | Ezbelent | 223/30 |
| 1,723,688 | 8/1929 | Ezbelent | 223/30 |
| 1,770,590 | 7/1930 | Ezbelent | 223/30 |
| 2,923,447 | 2/1960 | Ezbelent | 223/30 |
| 3,135,443 | 6/1964 | Demagny | 223/30 |

*Primary Examiner*—Louis Rimrodt

*Attorney, Agent, or Firm*—Parmelee, Bollinger & Bramblett

[57] ABSTRACT

In an apparatus for guiding the folding blades (3,5) and for actuating the tilting arm (24) of a blade bar (4) mounted pivotably on the jib (10) of a blade shaft (11), a reversible individual drive (23) with a pivoting member (21) which can move a rocker (16) to and fro between two positions serves for actuating the tilting arm (24). Mounted pivotably on the rocker (16) is an intermediate member (14) on which the tilting arm (24) is articulated on a pivot pin (13) at a distance from the point of articulation of the intermediate member (14) on the rocker (16). The geometry of the articulated chain formed by the jib (10), the pivoting member (21), the rocker (16), the intermediate member (14) and the tilting arm (24) is, at the same time, selected so that the tip of the particular folding blade (3) is guided along on the upper or lower contact plate (7,8) of the pleating machine as a function of the position of the pivoting member (21).

11 Claims, 16 Drawing Figures

APPARATUS FOR GUIDING THE FOLDING BLADE AND FOR ACTUATING THE TILTING ARM OF THE BLADE BAR OF A PLEATING MACHINE

The invention relates to an apparatus for guiding the folding blade and for actuating the tilting arm of a blade bar mounted pivotably on jibs of a blade shaft and belonging to a pleating machine.

Apparatuses of the type mentioned above are known, and in these the tilting movements for the blade bar are induced into the tilting arm by means of a roller guide. The tilting arm is, in this case, provided with a bolt carrying a roller which rolls on a roller guide. Here, the roller guide is fastened to a slide which carries a ball bearing and a tracer pin and which is drawn downwards by a spring via a lever. The ball bearing, together with the slide and the roller guide, is lifted against the effect of the spring by a cam disc during each return stroke of the folding blade, and at the same time a pattern wheel is rotated a fraction by means of a pawl. The pattern wheel is provided with so-called control pins which interact with the tracer pin so as to guide the folding blade along either on an upper or a lower contact plate.

The known apparatus is not entirely satisfactory in as much as, on the one hand, it has a complicated design and on the other hand, it can be changed over only with a considerable outlay in terms of time.

The object on which the invention is based is to provide an apparatus of the type in question, which is characterised by special simplicity and which gives the user of the machine equipped with the apparatus the possibility of much greater freedom of choice as regards the desired pattern. This object is achieved, according to the invention, by means of an apparatus which has a reversible individual drive for a pivoting member to pivot at least one rocker to and fro between two end positions, and due to the fact that mounted pivotably on the rocker is an intermediate member on which the tilting arm is articulated at a distance from its points of articulation on the rocker, the geometry of the articulated chain formed by the pivoting member, the rocker, the intermediate member, the tilting arm and the jib being selected so that the tip of the folding blade is guided along on the upper or lower contact plate of the pleating machine as a function of the position of the pivoting member.

The apparatus according to the invention, in which the indexing mechanism for the blade bar is formed by a four-bar articulated chain, has an extremely simple design. Since it has its own drive, there is no need for mechanical refitting or change-over of the machine when pleat patterns are changed. On the contrary, the individual drive can be controlled by means of a program control. Another advantage is that positive guidance of the blades is achieved as a result of the new apparatus, and this makes it possible to maintain a specific pressing force of the blade tips against the contact plates.

Further details and features of the invention emerge from the sub-claims and from the following description of several exemplary embodiments illustrated in the attached drawing, in which FIG. 1 shows an apparatus for actuating the lower blade bar of a pleating machine;

Figure 1:
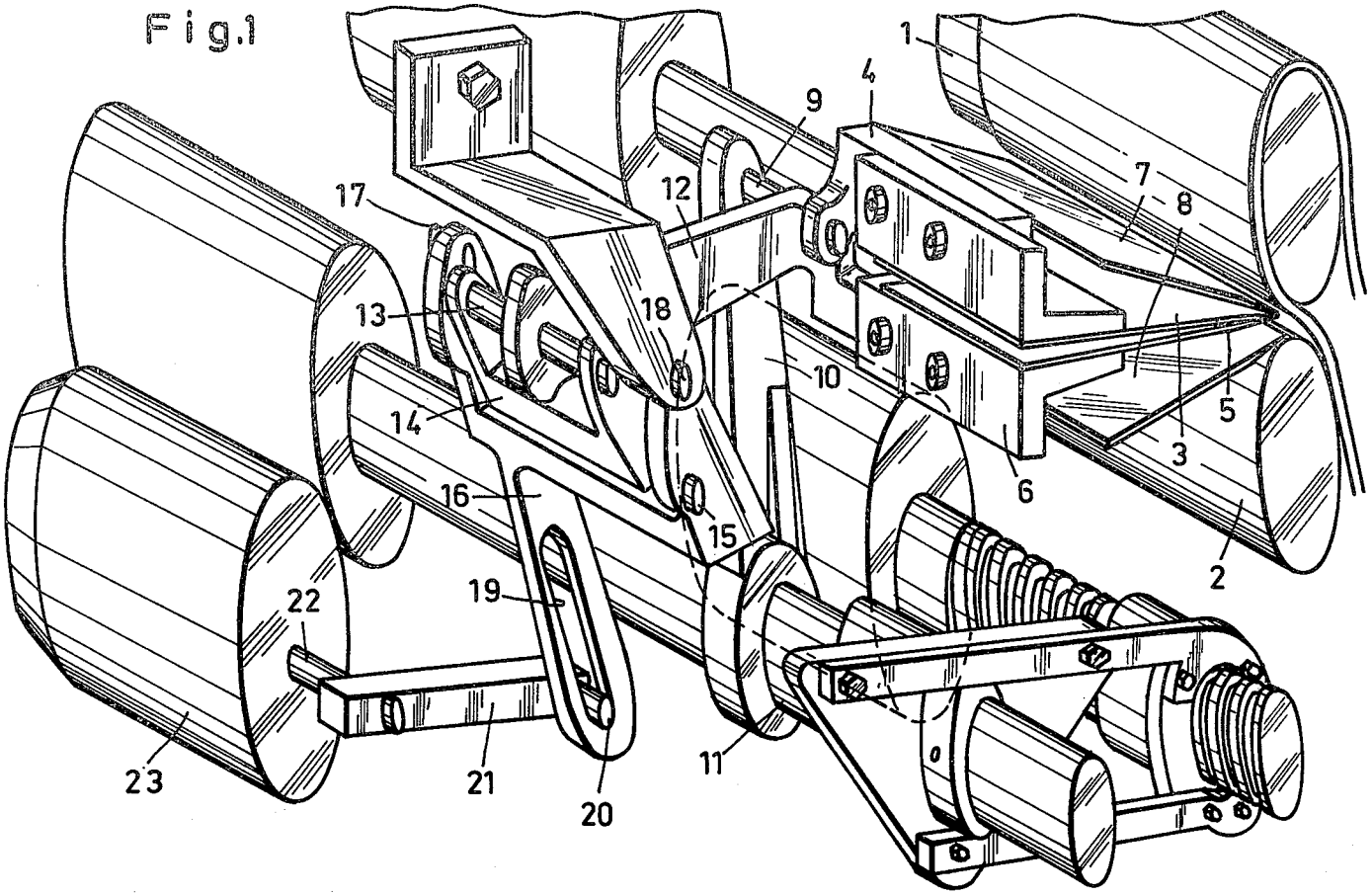
Figure 2:
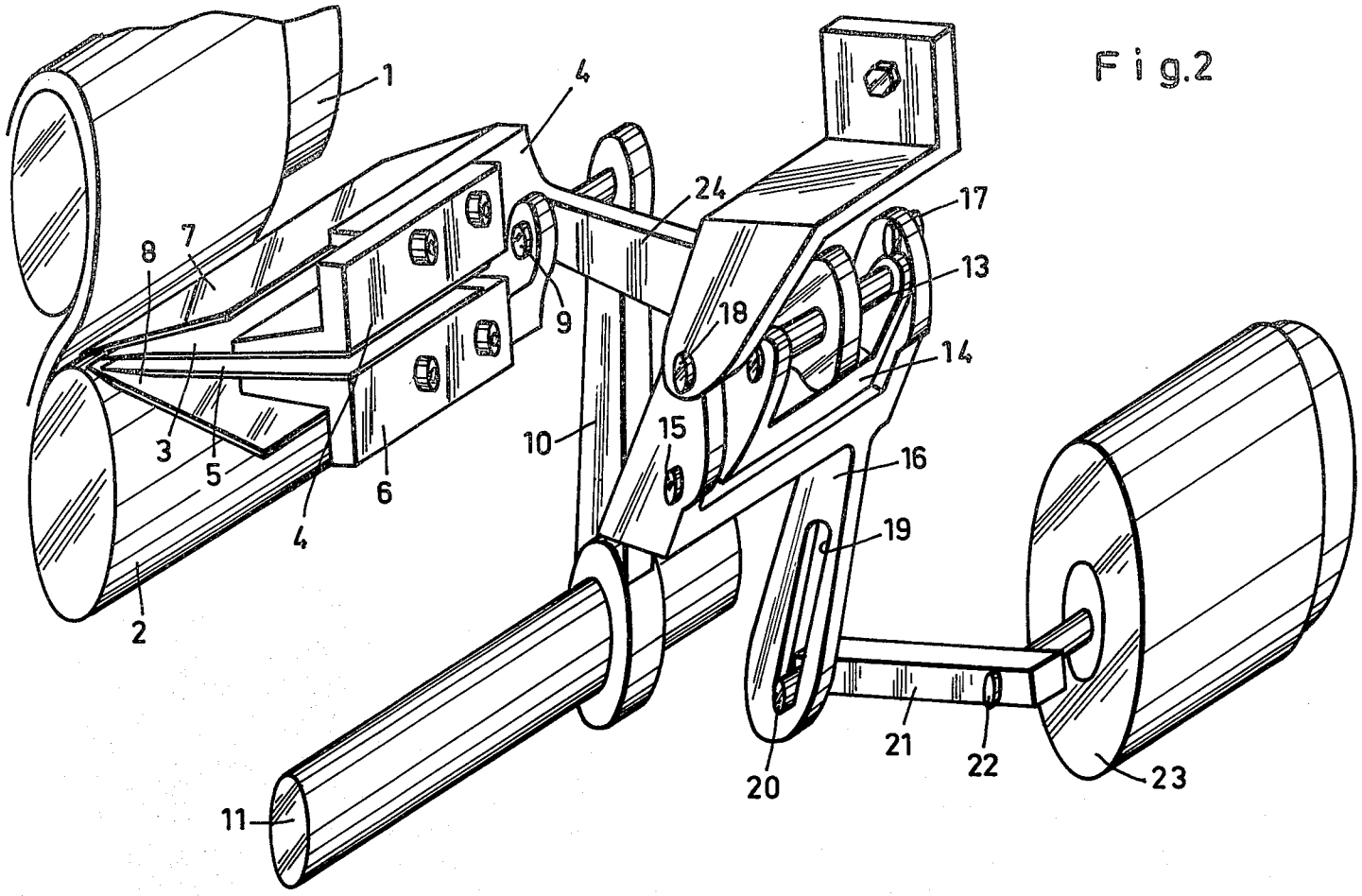
FIG. 2 shows an apparatus for actuating the upper blade bar of a pleating machine.

In FIG. 1, 1 and 2 are the pleating rollers of a pleating machine, the upper folding blade 3 of which is fastened to an upper blade bar 4 and the lower folding blade 5 of which is fastened to a lower blade bar 6. The folding blades move to and fro between an upper contact plate 7 and a lower contact plate 8. The two blade bars 4 and 6 are mounted pivotably on journals 9 located on the end of jibs 10 which are connected fixed against rotation or via a resilient engagement means to a blade shaft 11. 12 denotes the tilting arm for inducing a tilting movement into the lower blade bar 6. At its end facing away from the blade bar 6, the tilting arm 12 is mounted pivotably on the pivot pin 13 of an intermediate member 14 which is itself mounted pivotably on a rocker 16 by means of journals 15. The rocker 16 is itself mounted rotatably on the frame of a pleating machine via journals 17 and 18. It possesses a longitudinal guide 19 into which engages the engagement finger 20 of a pivoting member 21 which rests on the drive shaft 22 of a reversible individual drive 23.

When the machine is in operation, the pivoting member 21 is moved to and fro between two positions. One of the two positions is shown in FIG. 1. In the second position, the pivoting member 21 is pivoted approximately 180° to the left in relation to the position shown in FIG. 1.

Whereas the apparatus shown in FIG. 1 serves for tilting the lower blade bar 6, FIG. 2 shows an apparatus for tilting the upper blade bar 4 of the same pleating machine. The same reference numerals are used in FIGS. 1 and 2 for parts corresponding to one another. Here again, the tilting arm 24 of the upper blade bar 4 is mounted on a pivot pin 13 of an intermediate member 14 which in turn forms part of a four-bar articulated chain which includes the rocker 16 which can be driven by the pivoting member 21. Depending on the position of the pivoting member 21, the blade bars are pressed downwards or upwards. When the two pivoting members assume the position shown in FIGS. 1 and 2 during the advance of the blades, the folding blades are closed and the upper folding blade 3 is pressed against the upper contact plate 7 by the lower folding blade 5. When the pivoting member 21 is pivoted approximately 180° to the left, as seen in FIG. 1, when the dead center near the rollers is reached, a tilting movement is induced via the tilting arm 12 into the blade bar 6 and gives rise to a downward movement of the front edge of the lower folding blade 5. Consequently, during the return of the blades, the lower folding blade 5 is guided along on the lower contact plate 7, the folding blades 3,5 being opened. Depending on whether the folding blades 3 and 5 are pressed, during their advance, against the upper contact plate 7 or against the lower contact plate 8, backward or forward pleats are obtained.

Figure 3:
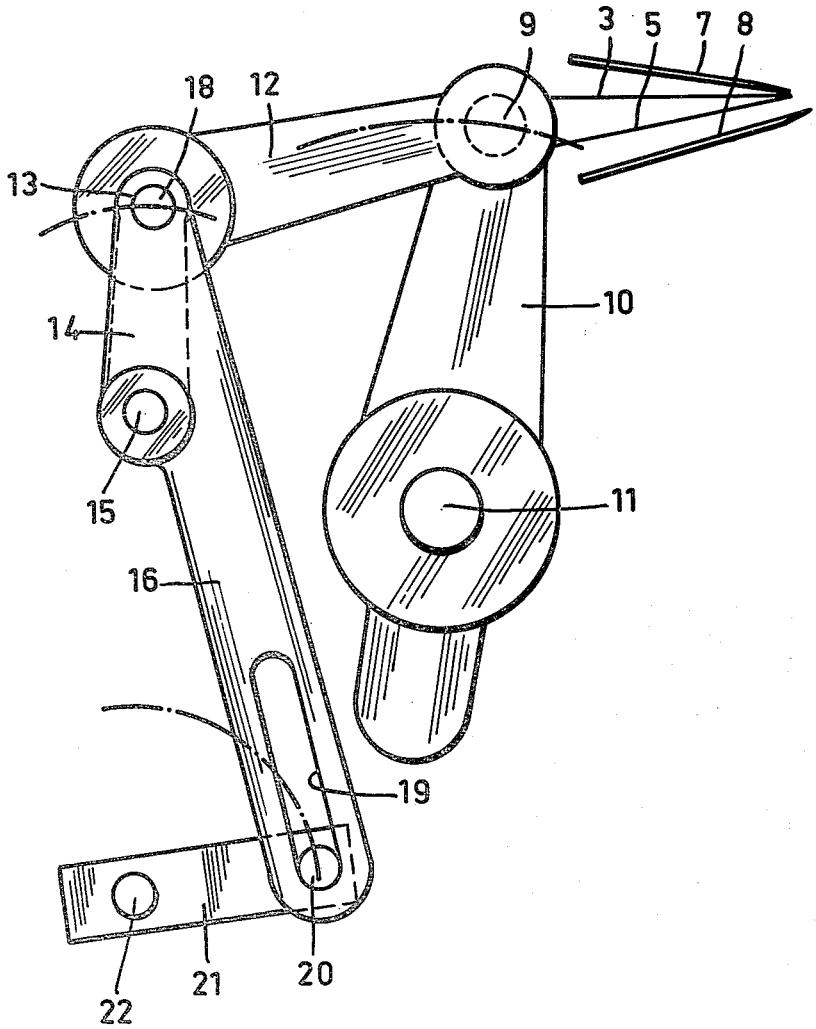
FIG. 3 shows the essential parts of the apparatus according to FIG. 1 at the end of the advance of the folding blades to form a backward pleat.
Figure 4:
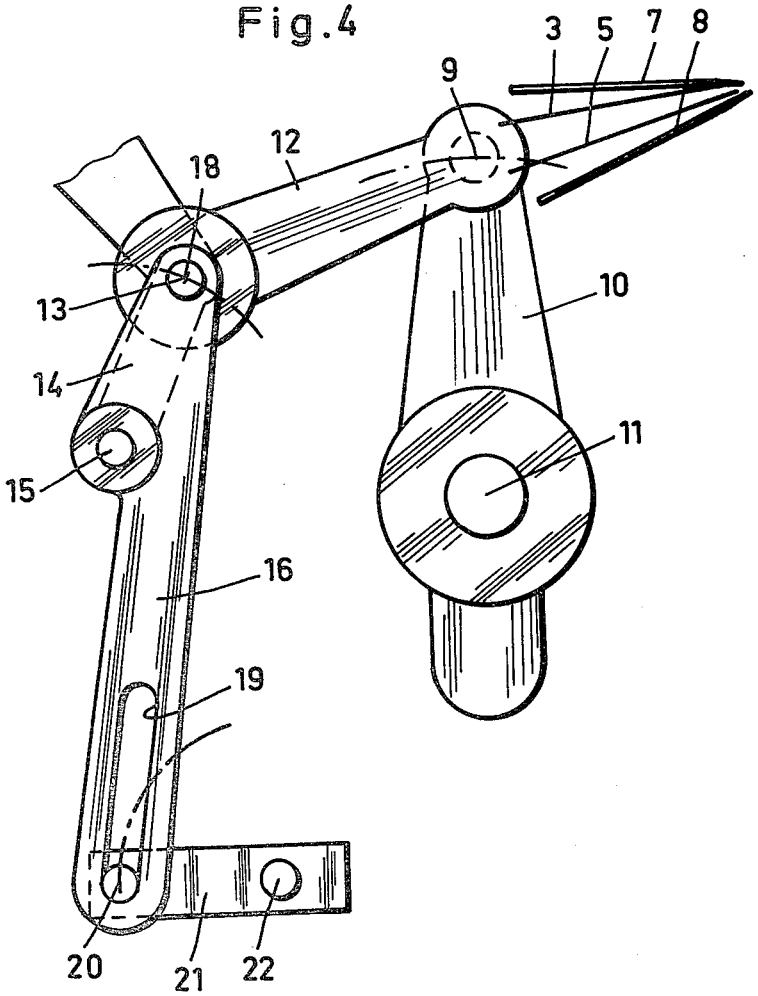
FIG. 4 shows the opening of the folding blades.
Figure 5:
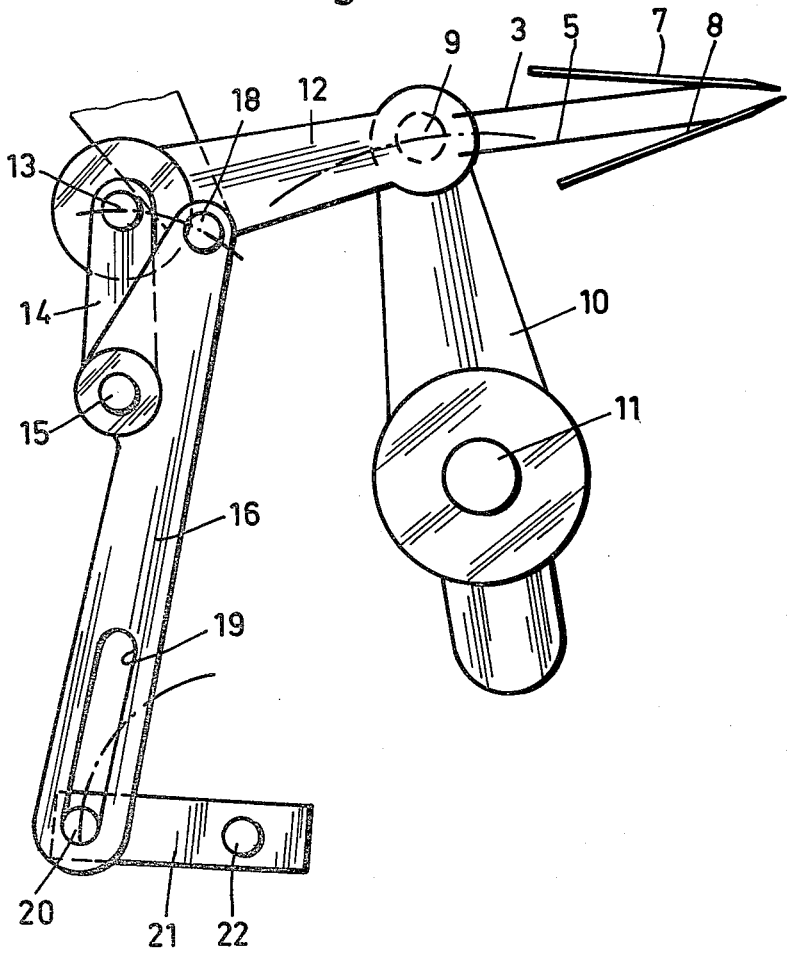
FIG. 5 shows an intermediate position of the folding blades during the return.
Figure 6:
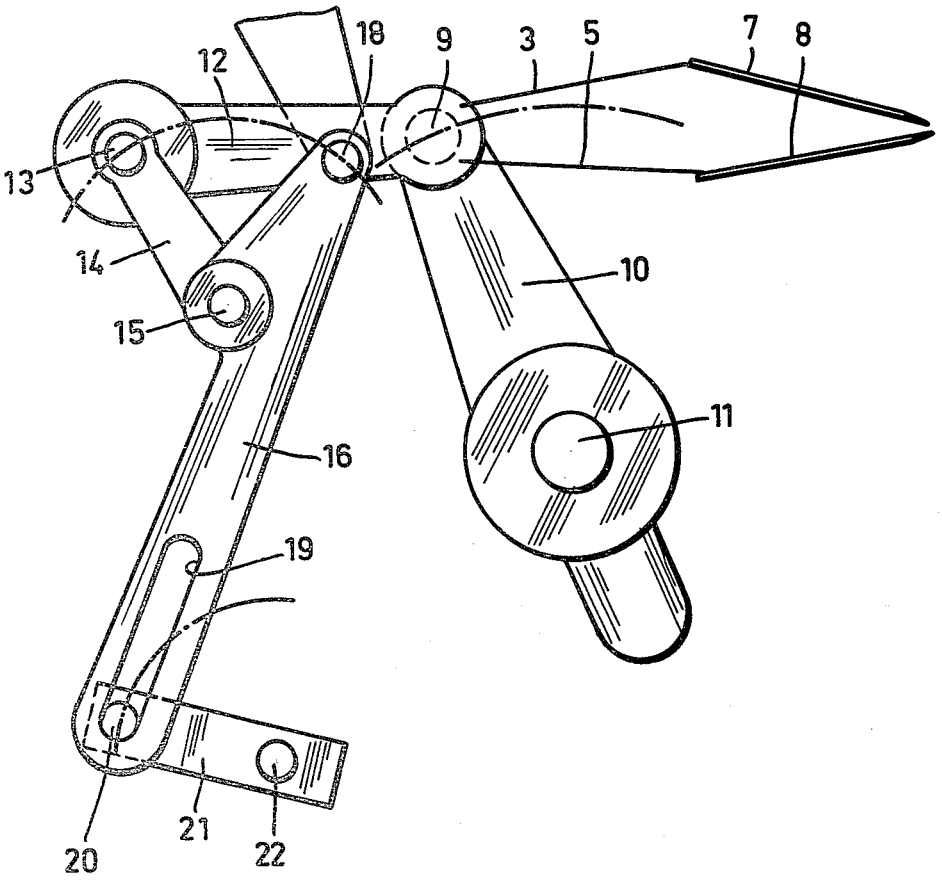
FIG. 6 shows the opened folding blades at the end of the return.
Figure 7:
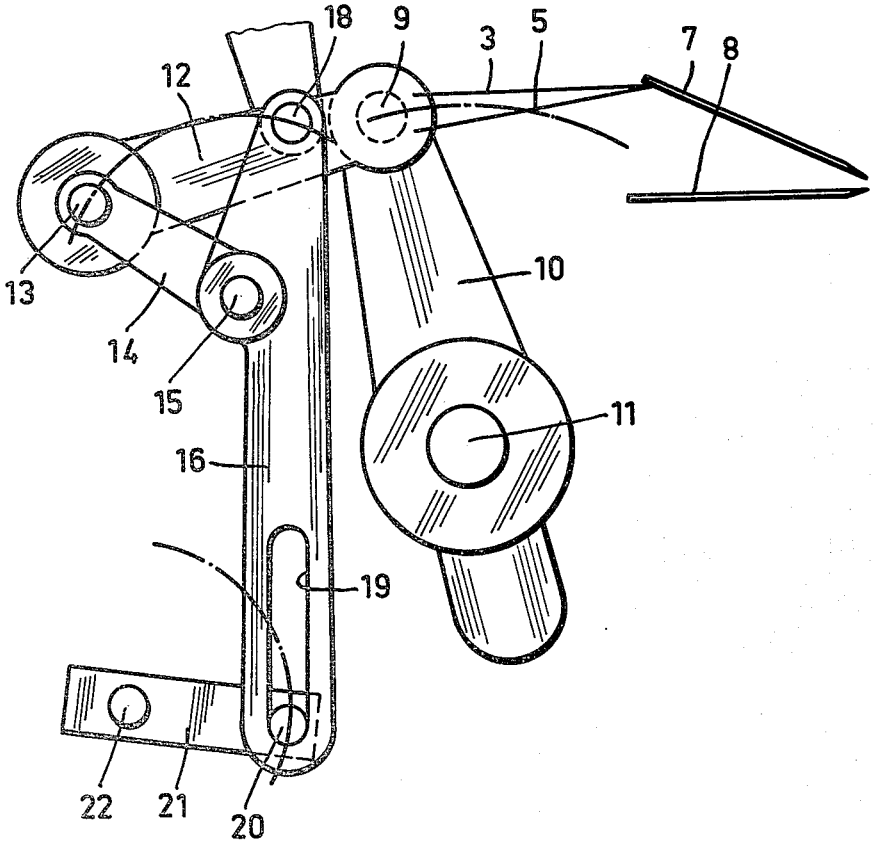
FIG. 7 shows the closing of the folding blades at the start of a new advance to form a backward pleat.
Figure 8:
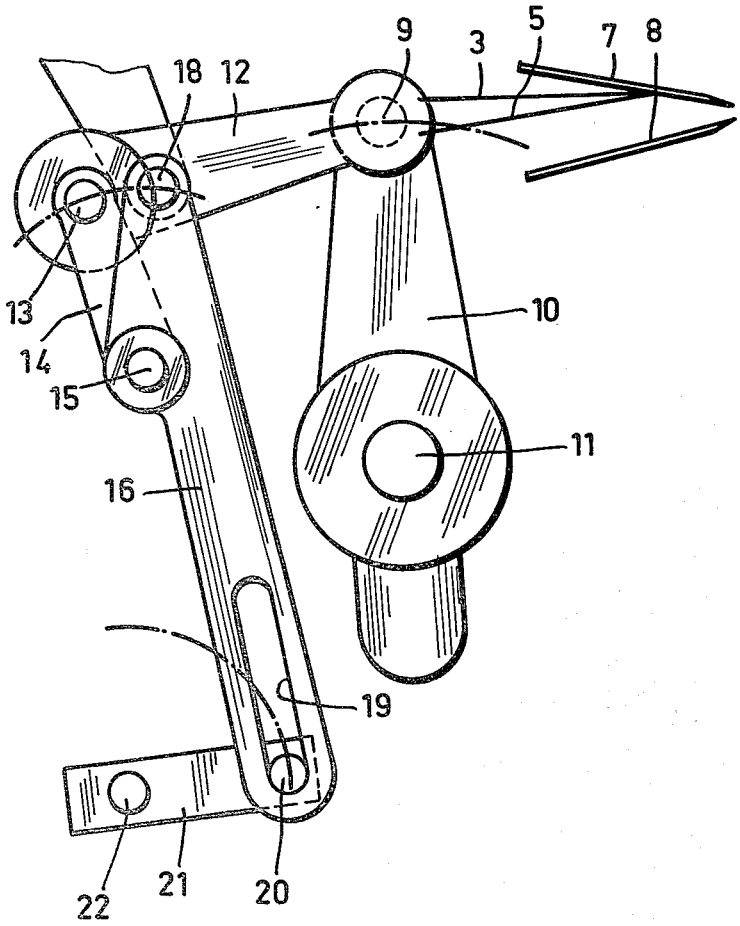
FIG. 8 shows an intermediate position of the folding blades during the advance in the course of which a backward pleat is formed.

When backward pleats are formed, the lower folding blade 5 presses the upper folding blade 3 against the contact plate 7. FIG. 3 shows the position of the folding blades at the end of the advance to form a backward pleat. A little later, the folding blades 3 and 5 are opened (see FIG. 4), and during the return, because of the kinematics of the two guide apparatuses, they are guided back on the contact plates 7 and 8 facing them (see FIG. 5) until they reach an end position (see FIG. 6). During the return, the pivoting member 21 of the apparatus according to FIG. 1 assumes a position on the left (see FIGS. 4 to 6), from which, at the start of a new advance, it is pivoted back again into the position shown in FIG. 1 (see FIG. 7) in which the backward pleat is formed (see FIGS. 8 and 3).

Figure 9:
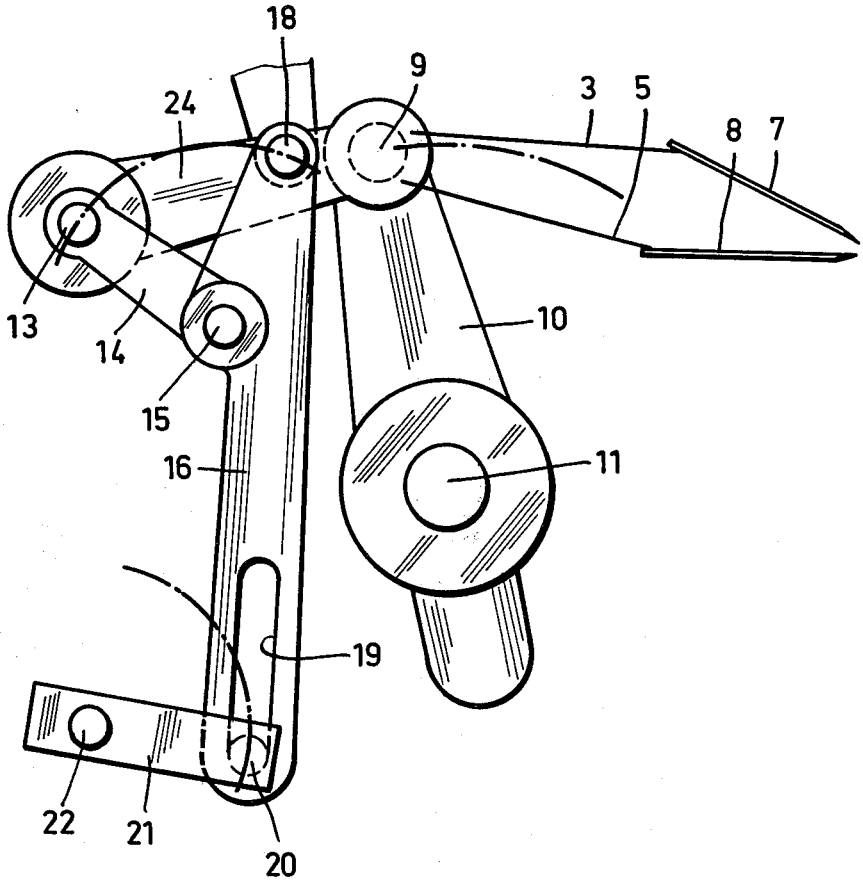
FIG. 9 shows the essential parts of the apparatus according to FIG. 2 in a position in which the parts of the apparatus according to FIG. 1 are in the position according to FIG. 6.
Figure 10:
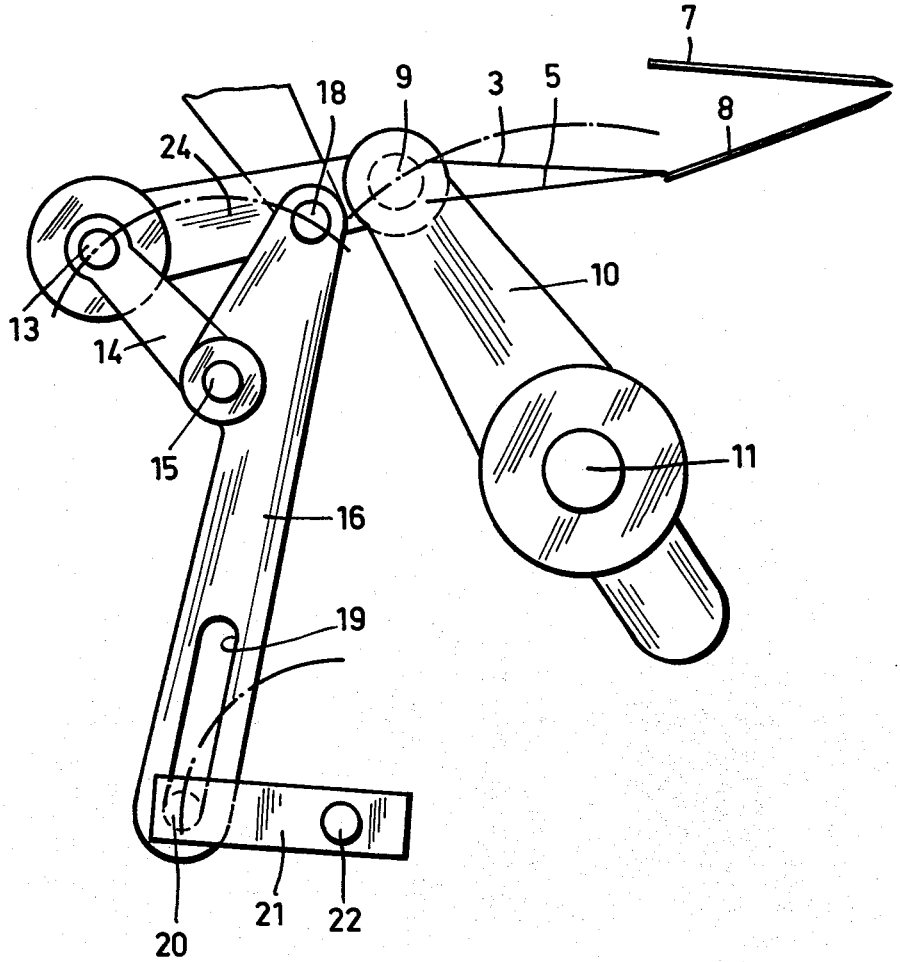
FIG. 10 shows the closing of the folding blades at the start of an advance to form forward pleats.
Figure 11:
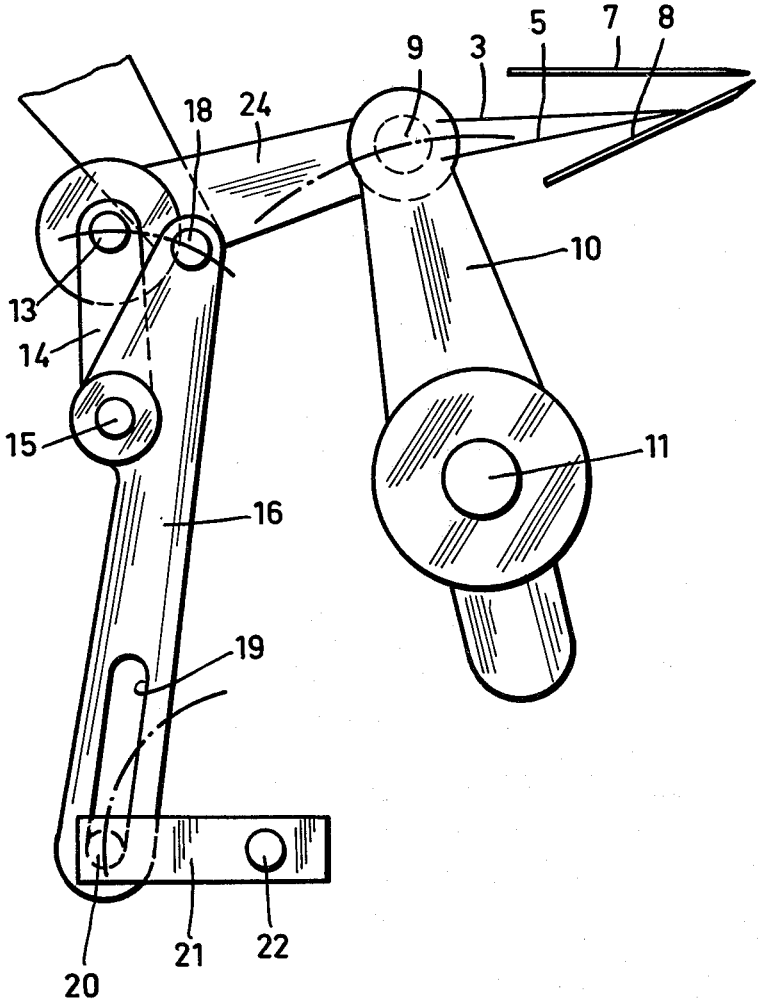
FIG. 11 shows an intermediate position of the folding blades during the advance in the course of which a forward pleat is formed.
Figure 12:
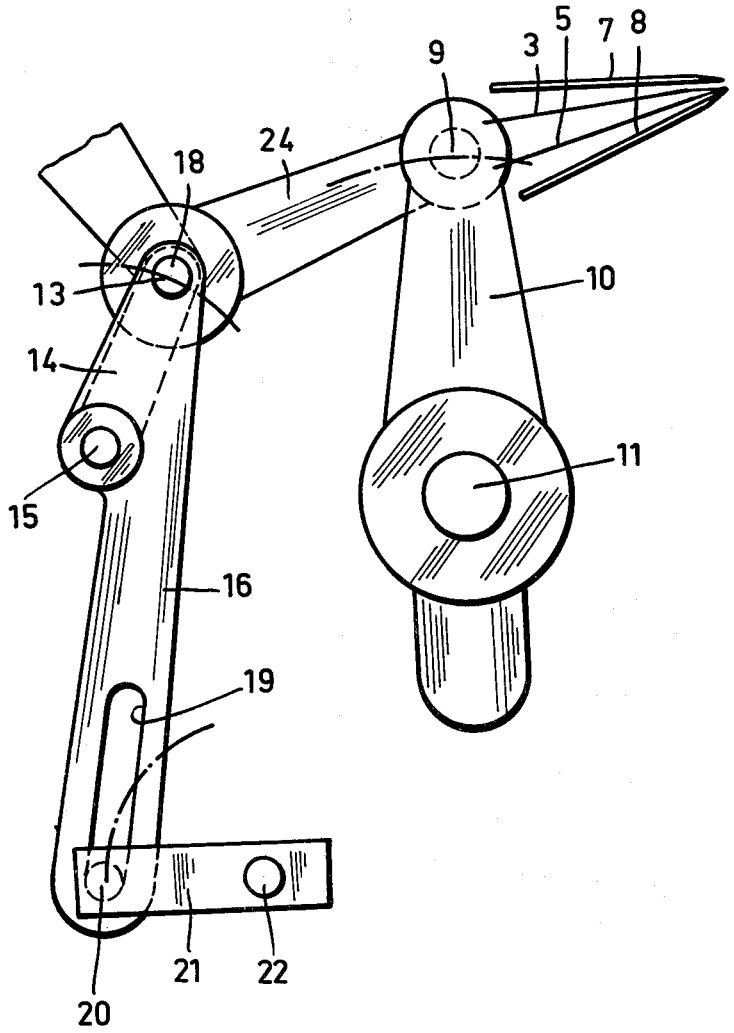
FIG. 12 shows the essential parts of the apparatus according to FIG. 2 at the end of the advance of the folding blades to form a forward pleat.
Figure 13:
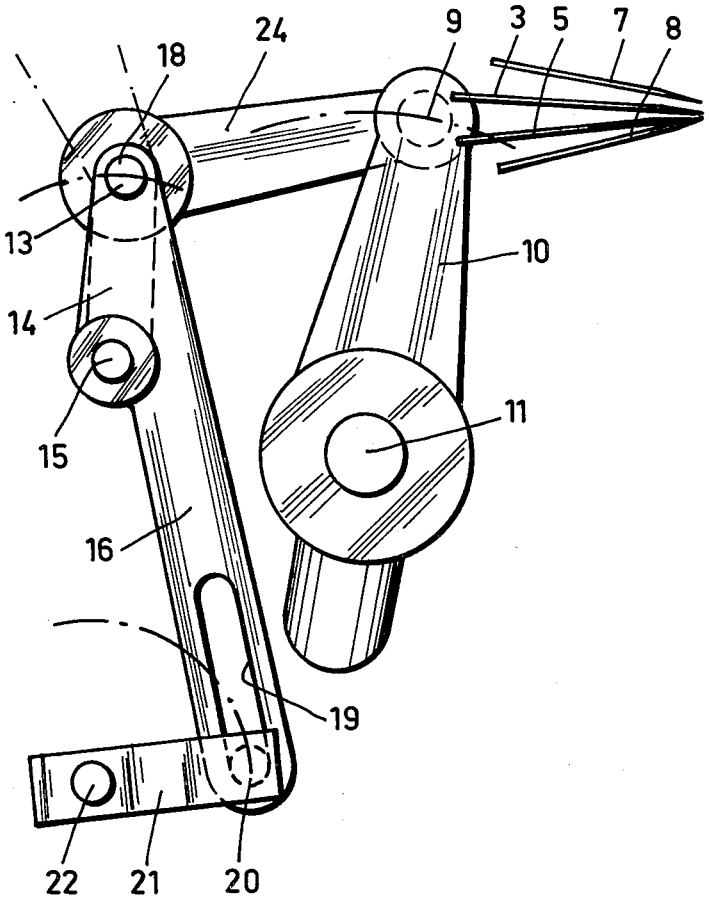
FIG. 13 shows the opening of the folding blades.
Figure 14:
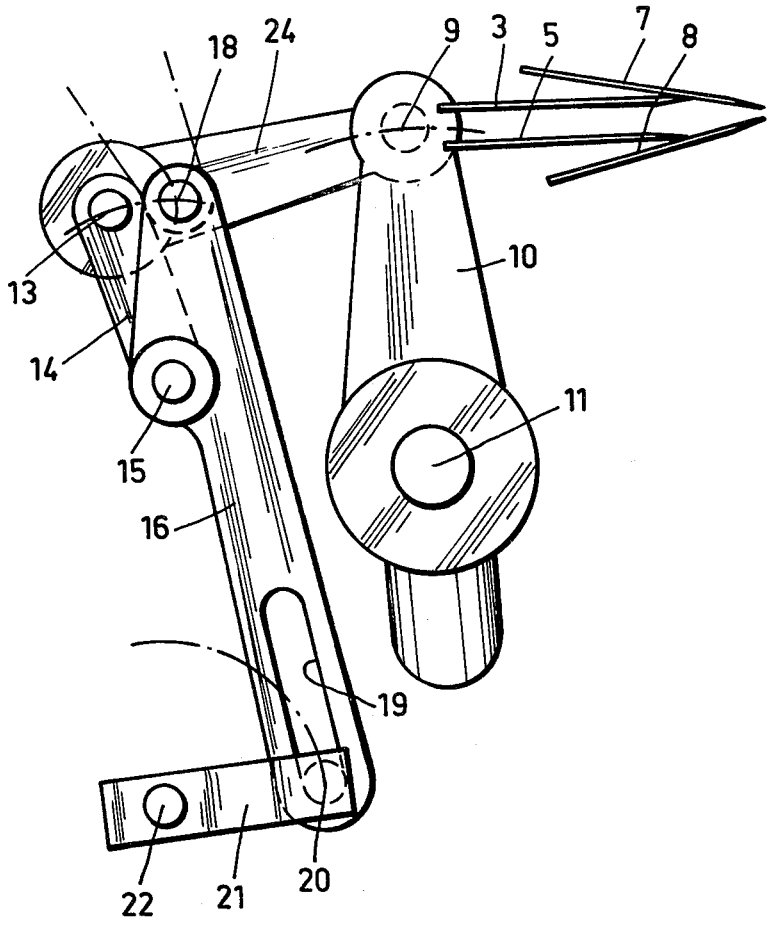
FIG. 14 shows an intermediate position of the folding blades during the return.

When a forward pleat is formed, the upper folding blade 3 presses the lower folding blade 5 against the lower contact plate 8. FIG. 9 shows the position of the folding blades 3,5 in the dead center of their path of movement remote from the rollers. Consequently, FIG. 9 corresponds to FIG. 6, except that it illustrates the position of the tilting arm 24, whereas in FIG. 6 the position of the tilting arm 12 is shown. From the position according to FIG. 9 the pivoting member 21 is pivoted approximately 180° into the position according to FIG. 10 which shows the folding blades 3 and 5 at the start of the advance for the purpose of forming a forward pleat. FIGS. 11 and 12 illustrate intermediate positions of the folding blades 3 and 5 during the formation of a forward pleat. In FIG. 13 the folding blades 3 and 5 open after reaching the dead center near the rollers. The position shown in FIG. 13 corresponds to the position of the parts in FIG. 2. Finally, FIG. 14 shows the folding blades 3 and 5 during the return.

Figure 16:
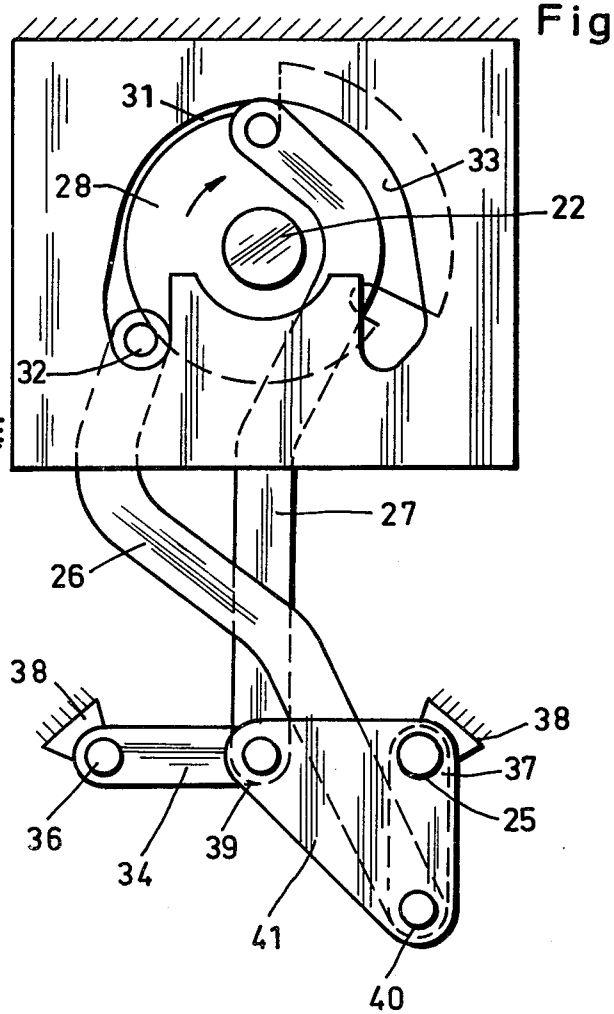
FIG. 16 shows the essential parts of the apparatus according to FIG. 15 in a second position.
Figure 15:
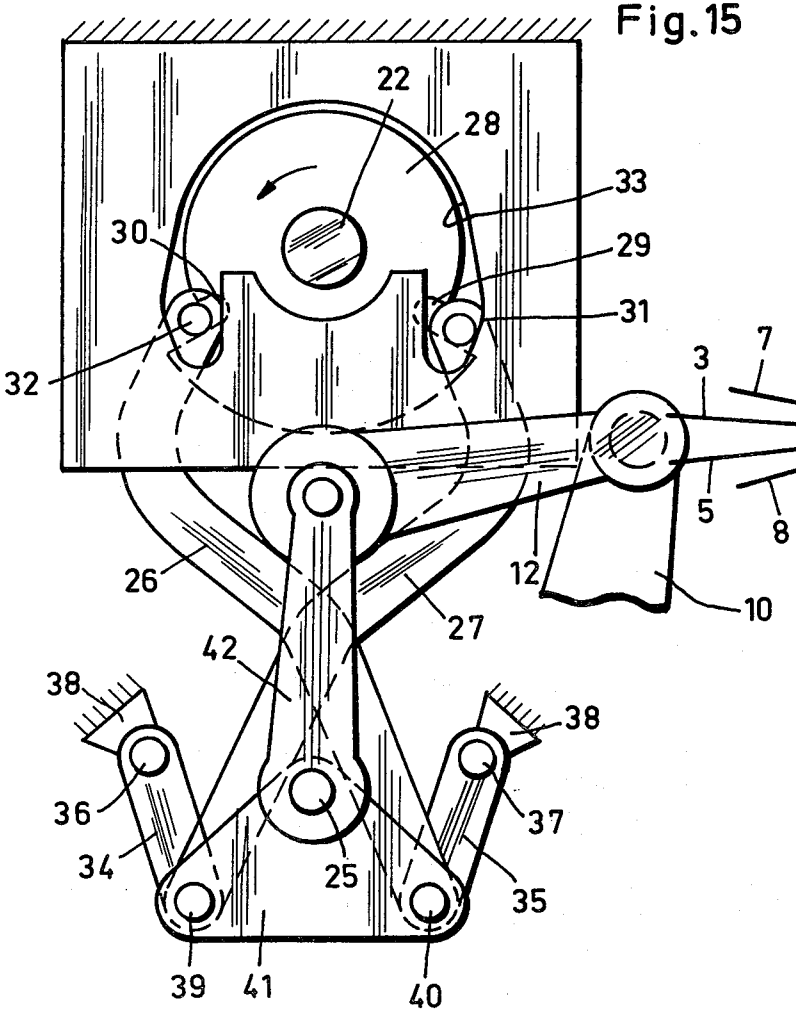
FIG. 15 shows the essential parts of a further apparatus in a first position.

FIGS. 15 and 16 illustrate a modified embodiment of a knife-tilting apparatus. It was decided not to reproduce the blades here. The pivot pin 25 of the exemplary embodiment according to FIGS. 15 and 16 corresponds to the pivot pin 15 in the solution described first.

In the second exemplary embodiment two actuating rods 26 and 27 which can be actuated by a pivoting member 28 are used. The pivoting member 28 is formed by a disc which has engagement grooves 29 and 30 for engagement fingers 31 and 32 located on the actuating rods 26 and 27. In each case, one engagement finger 31 or 32 can be guided along on a slotted guide 33 by means of the engagement grooves 29 and 30 respectively.

At their ends facing away from the pivoting member 28, the actuating rods 26 and 27 are connected to connecting rods 34 and 35 which are mounted on pivot pins 36 and 37 on the frame 38 of the machine. Furthermore, mounted on the journals 39 and 40 connecting the actuating rods 26 and 27 to the connecting rods 34 and 35 is a rocker 41 carrying the pivot pin 25 which corresponds to the pivot pin 15 of the first exemplary embodiment and to which an intermediate member 42 is articulated.

In this case also, the pivoting member 28 is mounted on the drive shaft 22 of an individual drive.

The same cycles of movement as with the embodiment described first can also be controlled by means of the second embodiment. The chosen arrangement of the actuating rods 26,27 produces a double toggle-lever effect which makes it possible to transmit high forces by means of the pivot pin 25 when they are in their end positions.

We claim:

1. Apparatus for guiding the folding blade and for actuating the tilting arm of a blade bar mounted pivotably on jibs of a blade shaft and belonging to a pleating machine, wherein the apparatus has an individual drive (23) for a pivoting member (21;28) to pivot at least one rocker (16;41) to and fro between two end positions, wherein mounted pivotably on the rocker (16; 41) is an intermediate member (14; 42) on which the tilting arm (12; 24) is articulated at a distance from its point of articulation (15) on the rocker (16; 41), the geometry of the articulated chain formed by the pivoting member (21; 28), the rocker (16; 41), the intermediate member (14; 42), the tilting arm (12; 24) and the jib (10) being selected so that the tip of the folding blade (3, 5) is guided along on the upper or lower contact plate (7, 8) of the pleating machine as a function of the position of the pivoting member (21; 28).

2. Apparatus according to claim 1, wherein the individual drive (23) is formed by an electric motor with a drive shaft (22) movable to and fro between two particular positions.

3. Apparatus according to claim 1, wherein the rocker (16) is mounted pivotably on the frame of the pleating machine.

4. Apparatus according to claim 1 or 3, wherein the rocker (16) is provided with a longitudinal guide (19) for an engagement finger (20) of the pivoting member (21).

5. Apparatus according to claim 4, wherein the pivoting member (21) is formed by a jib arm fastened to the drive shaft (22) of the individual drive (23) designed as an electric motor.

6. Apparatus according to claim 1, 2 or 3, wherein the rocker (16) has a fork between the prongs of which the intermediate member (14) is mounted.

7. Apparatus according to claim 6, wherein the intermediate member (14) is made U-shaped and has two legs which extend parallel to the prongs of the fork of the rocker (16) and the free ends of which are connected by a pivot pin (13) for the tilting arm (12, 24).

8. Apparatus according to claim 1, wherein the rocker (41) is mounted on connecting rods (34, 35) which are themselves mounted pivotably on the frame (38) of the pleating machine.

9. Apparatus according to claim 8, wherein the apparatus has two actuating rods (26, 27) connected to the frame (38) of the pleating machine via the connecting rods (34, 35), the rocker (41) also being articulated to the actuating rods (26,27) at the points of articulation of the connecting rods (34, 35).

10. Apparatus according to claim 9, wherein the pivoting member (28) is formed by a disc with engagement grooves (29, 30) for engagement fingers (31, 32) located on the actuating rods (26, 27).

11. Apparatus according to claim 10, wherein an engagement finger (31, 32) is moveable, in each case, to and fro in a slotted guide (33) by means of the engagement grooves (29, 30).

* * * * *